United States Patent [19]

Franklin et al.

[11] 4,441,548

[45] Apr. 10, 1984

[54] HIGH HEAT TRANSPORT CAPACITY HEAT PIPE

[75] Inventors: James L. Franklin, Kent; Dale F. Watkins, Sumner, both of Wash.

[73] Assignee: The Boeing Company, Seattle, Wash.

[21] Appl. No.: 334,856

[22] Filed: Dec. 28, 1981

[51] Int. Cl.[3] ..... F28D 15/00

[52] U.S. Cl. ..... 165/104.26; 165/104.27

[58] Field of Search ..... 165/104.26, 104.27

[56] References Cited

U.S. PATENT DOCUMENTS

| | | | |
|---|---|---|---|
| 3,620,298 | 11/1971 | Somerville | 165/104.26 X |
| 3,734,173 | 5/1973 | Moritz | 165/104.26 X |
| 3,913,665 | 10/1975 | Franklin et al. | 165/104.26 X |
| 3,971,634 | 7/1976 | Ranken et al. | 165/104.26 X |
| 4,020,898 | 5/1977 | Grover | 165/104.26 X |
| 4,040,478 | 8/1977 | Pogson et al. | 165/104.26 X |
| 4,127,105 | 11/1978 | Watt | 126/433 X |

OTHER PUBLICATIONS

G. D. Johnson et al., *Arterial Wick Heat Pipes*, ASME Publication 72-WA/HT-36, 8 pages, 11/72.

*Primary Examiner*—Albert W. Davis, Jr.
*Attorney, Agent, or Firm*—William C. Anderson

[57] ABSTRACT

A heat pipe (90) of increased heat transport capacity, capable of being primed under gravity conditions, comprises a sealed envelope (95) defining an evaporator (110) and a condenser (115). An arterial tube (125) of large liquid carrying capability is provided with an axial slot (130) formed on the upper surface of a segment of the tube (125). The slot (130) has beveled surfaces (135), (140) which increase the capillary pumping action to transverse wicking bodies (150, 155). The bodies (150, 155) transport working fluid to or from circumferential grooves (120) formed in the evaporator (110) and condenser (115).

8 Claims, 4 Drawing Figures

HIGH HEAT TRANSPORT CAPACITY HEAT PIPE

TECHNICAL FIELD

This invention relates generally to thermal transfer systems and more particularly to heat pipes having improved thermal performance.

BACKGROUND OF THE INVENTION

A basic heat pipe comprises a closed or sealed envelope or a chamber containing an isotropic liquid-transporting wick and a working fluid capable of having both a liquid phase and a vapor phase within a desired range of operating temperatures. When one portion of the chamber is exposed to a relatively high temperature it functions as an evaporator section. The working fluid is vaporized in the evaporator section causing a slight pressure increase forcing the vapor to a relatively lower temperature section of the chamber defined as a condenser section. The vapor is condensed in the condenser section and returned through the liquid-transporting wick to the evaporator section by capillary pumping action.

Because it operates on the principle of phase changes rather than on the principles of conduction or convection, a heat pipe is theoretically capable of transferring heat at a much higher rate than conventional heat transfer systems. Nevertheless a number of difficulties have been experienced in attempting to use heat pipes for certain applications. material such as a fine-pore wire mesh, the rate of fluid mass flow and consequently heat transfer is limited due to the high pressure drop encountered by the fluid as it flows through the wire mesh. To eliminate this pressure drop, permit increased fluid flow rates and increase heat transfer rates or heat transport capacities, pedestal-artery type heat pipes have been fashioned.

In a pedestal-artery type heat pipe, a fluid-conducting wire mesh artery is supported by a wire mesh stem in fluid communication with a wicking medium or fine circumferential grooves disposed on the inner periphery of the heat pipe wall. The fluid-conducting artery is generally designed to promote automatic priming or filling. Once filled, the artery characteristically has a pressure drop equivalent to a round tube allowing relatively high heat transport capacities.

In the absence of gravity (e.g., in space), any size artery of this type can theoretically prime. However, most heat pipes suitable for use in space applications must pass a ground (gravity) test before the heat pipe can be used. In the presence of gravity, artery priming is governed by design factors limiting heat pipe transport capacities to only thousands of watt-inches (heat transport rate times distance). However, analysts have estimated that future heat pipe transport capacities in the range of millions of watt-inches may be required thereby necessitating a new approach to artery design. Such a new approach is presented in the instant invention.

SUMMARY OF THE INVENTION

The present invention provides an improved heat pipe having an enhanced heat transport capacity and which may be readily primed in a gravity environment. Briefly, the preferred embodiment of the present invention comprises a sealed tube having an evaporator and a condenser. A working fluid, capable of having a liquid/vapor phase change, fills the tube whereby the fluid may be vaporized in the evaporator and condensed in the condenser. An artery, disposed within the tube, conducts condensed liquid by capillary action from the condenser to the evaporator and is provided with a channel formed on its upper surface. The channel has beveled surfaces abuttingly contacting a porous capillary slab which extends radially outward from the channel to a wick disposed about the inner periphery of the tube within the evaporator and the condenser. The channel may extend between the evaporator and the condenser whereby when the heat pipe is being primed, venting of the channel may be readily effected.

BRIEF DESCRIPTIONS OF THE DRAWINGS

DETAILED DESCRIPTION OF THE INVENTION

Figure 1:
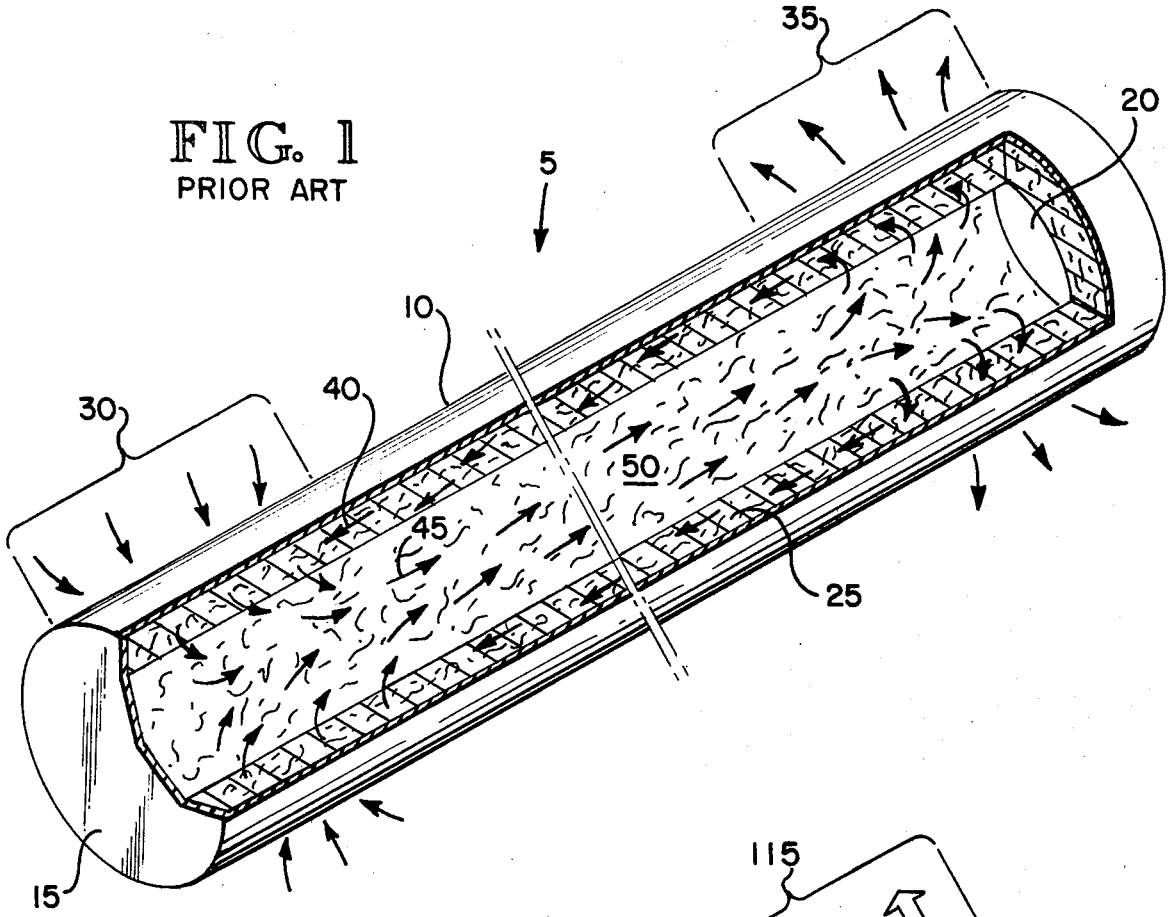
FIG. 1 PRIOR ART
FIG. 1 is a perspective schematic view, with parts broken away, of the structure of a basic heat pipe.

Referring to FIG. 1, an embodiment of a typical heat transfer system in the form of a heat pipe 5 is illustrated. The heat pipe 5 comprises a sealed envelope or a tube 10 sealed on both ends 15 and 20. An internal isotropic capillary pumping structure such as a wick 25 extends between an evaporator section 30 and a condenser section 35.

In use, the transfer of heat energy occurs when the evaporator section 30, exposed to a relatively high temperature or a heat source (not shown), produces a vaporization of a working fluid 40 capable of having a liquid/vapor phase change. A slight pressure increase results from the vaporization of the fluid 40 within the evaporator section 30 whereby the vapor 45 flows through the interior 50 of the heat pipe 5 to the relatively cooler, lower pressure condenser section 35 which rejects heat to some external heat sink (not shown). The vapor 45 is condensed in the condenser section 35 and returned through the wick 25 to the evaporator section 30 by capillary action.

The wick 25, illustrated in FIG. 1, typically comprises a fine mesh screen fitted tightly to the wall of the tube 10. A wick of this type is generally satisfactory but the high pressure drop encountered by the fluid 40 flowing through the screen limits the rate of fluid mass flow resulting in a limitation in the heat transport capacity of the heat pipe 5. To eliminate this pressure drop and permit increased fluid flow rates, improved heat pipes, such as, e.g., pedestal-artery type heat pipes 55, illustrated in FIG. 2 (only the condenser section 35' is shown), have been developed.

The heat pipe 55 comprises a sealed envelope or a tube 60 having a pedestal artery 65 fashioned from a fine pore screen mesh. The pedestal artery 65 comprises an artery 70 supported within the tube 60 by means of an artery stem 75. Disposed within the interior periphery of the tube 60 is a thin outer wick, comprising a plurality of circumferential grooves 80.

During operation of the heat pipe 55, working fluid 85 flows from a primed artery 70 through the stem 75 to the outer wick 80 disposed in the evaporator section (not shown) of the heat pipe 55. In the evaporator section, working fluid 85 evaporates from the outer wick 80. In the condenser, the reverse occurs. Fluid 85 (see FIG. 2) condenses on the outer wick 80 and subsequently flows through the stem 75 to the artery 70 where it is transported back to the evaporator section.

Figure 2:
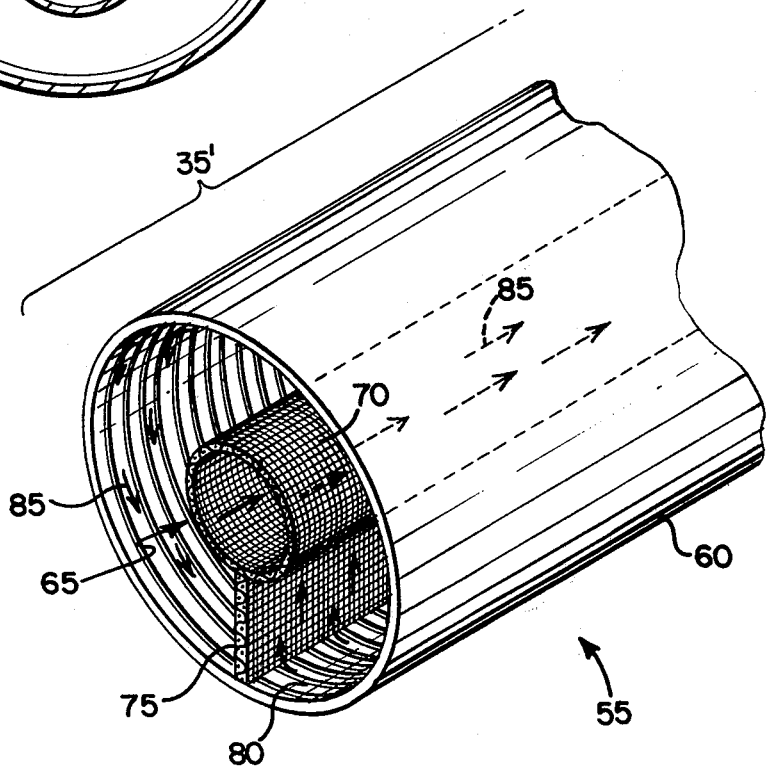
FIG. 2 PRIOR ART
FIG. 2 is a partial perspective schematic view of a conventional heat pipe having an arterial wick.

Two significant advantages may be accrued from the basic artery wick system shown in FIG. 2. First, the artery 70 provides an unobstrutured passage for liquid flow thereby resulting in relatively small pressure drops. Secondly, the thin outer wick 80 has little thermal resistance. The outer wick need only be about 0.01 inches thick because bulk liquid flow occurs in the artery 70. The primary temperature drops in a heat pipe typically occur through the outer wick 80, and reductions in this resistance substantially reduces the source to sink temperature gradient.

The advantages of low thermal gradience and relatively small liquid pressure drops can be realized only if the pedestal artery 65 is properly operating. The pedestal artery 65 is designed to fill or prime by itself and once filled has a pressure drop comparable to a round tube.

In the absence of gravity (space), a pedestal artery of any size will theoretically prime but most heat pipes suitable for use in space environments must also pass a ground test before launch into space. In the presence of gravity, priming for a pedestal artery is governed by the following equation:

$$\rho g(h_s+2r_a)=2\sigma/r_a$$

where $\rho$=fluid density, lbm/ft$^3$ g=gravity $h_s$=stem height, ft.

$r_a$=artery radius, ft.

$\sigma$=fluid surface tension, lbf/ft ft=feet; sec=seconds; lbf=pounds force; lbm=pounds mass; Btu=British thermal units As will be apparent to the skilled artisan, the maximum artery diameter as well as the heat transport×distance capacity of the heat pipe 55 is limited. For example, with a fluid such as ammonia and a pedestal stem height of 0.050 inches, the maximum artery diameter is limited to 0.0392 inches. In practice, this translates to a heat transport capacity of 5370 watt-inches (heat transport rate times distance).

The heat pipe of the present invention is capable of providing heat transport capacities in the range of millions of watt-inches. Furthermore, the high heat transport heat pipes of the present invention are readily primed or filled in an accelerational (earth gravity) environment.

Figure 3:
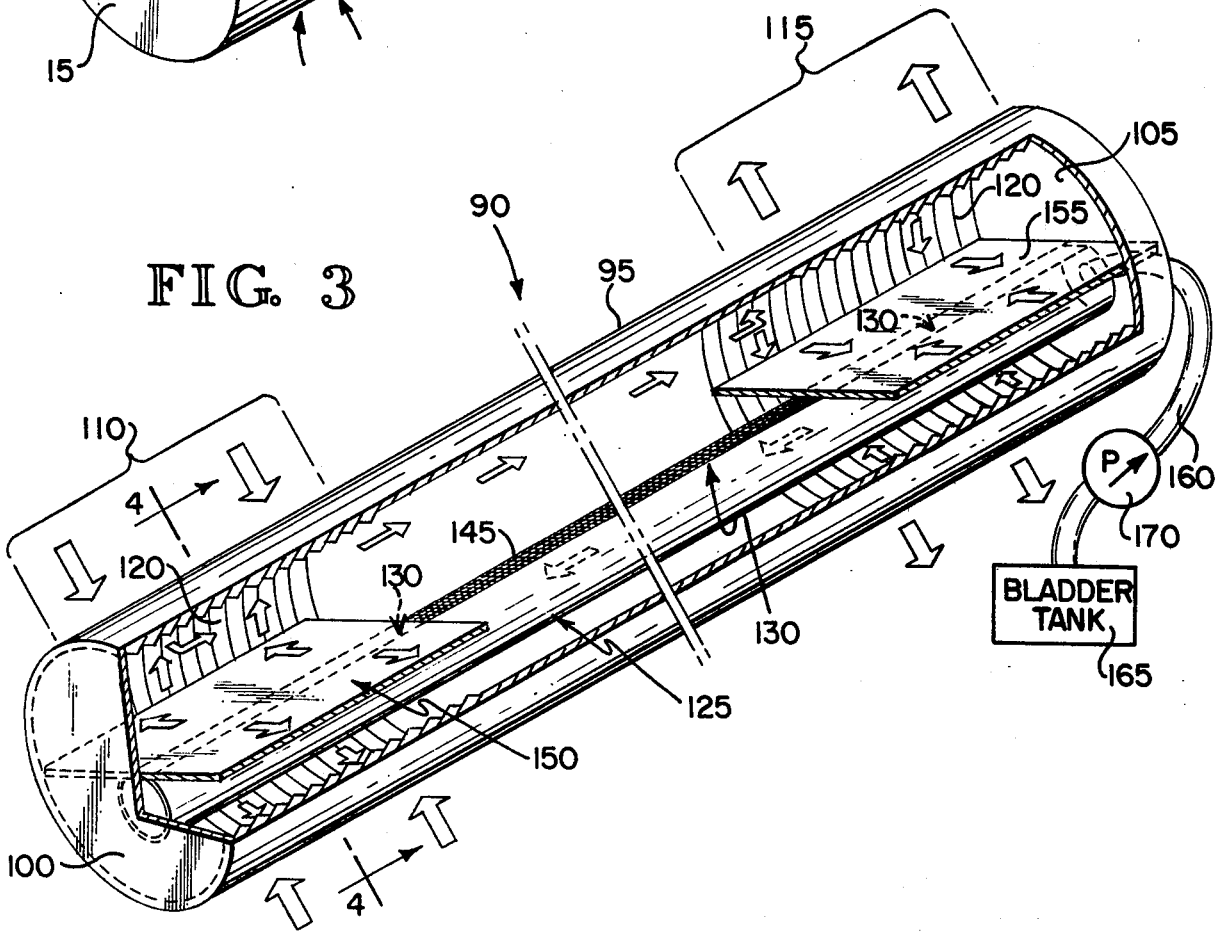
FIG. 3 is a perspective schematic view, with parts broken away, of a preferred embodiment of the improved heat pipe of the present invention.

Referring now to FIG. 3, a preferred embodiment of a heat pipe 90 of the present invention is illustrated. The heat pipe 90 comprises a sealed envelope or a tube 95 sealed or closed at an end 100 and at another end 105. Arbitrarily, the section of the heat pipe near the end 100 is defined as an evaporator 110 and a condenser 115 is defined near the end 105. Axially distributed circumferential capillary grooves 120 are formed in the evaporator 110 and the condenser 115.

Disposed within the tube 95 is a fluid conducting closed-ended, solid wall arterial tube 125 having an axial slot or a channel 130 formed in the upper portion of a segment of the tube 125. The channel 130 is provided with a beveled surface 135 and a beveled surface 140 which may extend only within the evaporator 110 and the condenser 115 or may extend both between and within the evaporator 110 and the condenser 115. If the channel 130 extends between the evaporator 110 and the condenser 115, it may be covered by a suitable screen 145 to permit venting of gas during priming of the heat pipe. It should be noted that the beveled surfaces 135 and 140 lie in a plane that is parallel to the longitudinal axis of the tube 125 for a reason which will be clear shortly.

Figure 4:
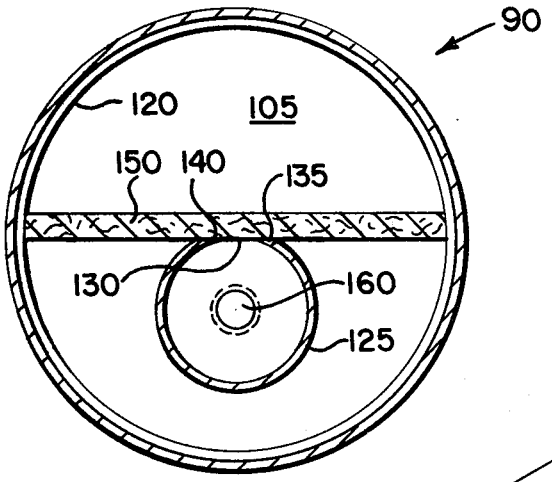
FIG. 4 is a sectional view taken on line 4—4 of FIG. 3.

Referring now to FIG. 4, a transverse wick body 150, comprising a suitable capillary material such as a fine pore screen (400 mesh/inch) or a bonded metal felt, is disposed within the evaporator 110 contiguous to and abuttingly contacting the beveled surfaces 135 and 140 throughout their entire surface area. Another transverse wick body 155 (see FIG. 3) is disposed within the condenser 115 contiguous to and abuttingly contacting the beveled surfaces 135 and 140 in the condenser. Both the wick body 150 and the wick body 155 extend radially outward from the channel 130 to the grooves 120.

A tube 160, communicating with the arterial tube 125, communicates with a working fluid reservoir or a bladder tank 165. When a pump 170 is activated, working fluid is drawn from the tank whereby the arterial tube 125, wick bodies 150, 155 and capillary grooves 120 are completely filled with the working fluid. Once priming of the heat pipe is completed, the pump 170 is inactivated. Priming of the heat pipe 90 in a gravity environment must be accomplished using the pump 170.

In use, the working fluid is vaporized within the grooves 120 in the evaporator 110 and is transported under pressure to the condenser 115 where it condenses into a liquid in the circumferential grooves 120. The capillary grooves 120 transport the condensed liquid to the wick body 155 which carries it by capillary action to the channel 130. The fluid then flows into the interior of the tube 125 and is conducted back to the evaporator 110.

Since the wick body 150 is in fluid communication with the arterial tube 125, fluid flows from within the tube 125 and is transported to the circumferential grooves 120 formed within the evaporator 110. The working fluid is again vaporized in the evaporator 110 and the process begins anew.

A small laboratory version of a portion of the preferred embodiment of the present heat pipe has been built and tested for a short period. The test unit comprised an 8 to 10 inch section of a slotted arterial tube having an internal diameter of about 0.42 inches. Wide porous tabs comprising wick bodies were attached at each end of the tube. One set of tabs, defined as being a condenser section, was bent down in an inverted U-shape and submerged in a liquid pool of R-113 working fluid. The other wick body was left out in the air whereby the R-113 working fluid was evaporated directly from the exposed tab.

As a result of this and other tests it was discovered that the ideal arterial tube of the present invention should have a flattened top configuration, i.e., the beveled surfaces 135 and 140 are more advantageous than a simple slot in the wall of the tube 125. It is believed that the beveled surfaces 135, 140, which lie in a plane parallel to the longitudinal axis of the tube 125, are an important factor in the capillary pumping of fluid from the interior of the filled tube 125 to the wick body 150 or from the wick body 155.

The maximum heat transport capacity of the test unit (when fully primed) was ascertained by combining the following two equations:

$$Q \cdot L = \dot{m} \cdot h_{fg} \cdot L = \frac{\Delta P \cdot h_{fg} \cdot \rho \cdot \pi \cdot D^4 \cdot g_c}{128\mu}$$

$$\Delta P = \frac{2\sigma}{r_c}$$

where $h_{fg}$=latent heat of vaporization, Btu/lbm

D=artery diameter, ft.

$\mu$=fluid viscosity, lbm/ft-sec.

$r_c$=screen cover pore radius, ft.

$\dot{m}$=condensed fluid mass flow rate, lbm/sec.

The maximum heat transport capacity of the test unit was $77.16 \times 10^6$ watt-inches with an R-113 fluid. With a working fluid such as ammonia and a larger diameter arterial tube, capacities in the multi-million watt-inch range are feasible.

Although a preferred embodiment of the invention has been illustrated in the accompanying drawings and described in the foregoing detailed description it will be understood that the invention is not limited to the embodiments disclosed but is capable of numerous rearrangements, modifications and substitutions of the disclosed parts and elements without departing from the spirit of the invention.

What is claimed and desired to be secured by Letters Patents of the United States is:

1. An improved heat pipe of increased heat transport capacity, comprising:

a sealed envelope, a working fluid contained within said envelope; said fluid being capable of undergoing a liquid/vapor phase change, an evaporator section defined within said envelope for vaporizing said fluid, a condenser section defined within said envelope for condensing said vaporized fluid, whereby a liquid is formed, means forming a solid wall artery disposed within said envelope extending between said condenser section and said evaporator section for conducting said liquid by capillary action from said condenser section to said evaporator section, a channel formed on the upper surface of said artery; said channel being provided with beveled surfaces, means forming a liquid conducting wick; said wick means lying along the inner periphery of said envelope and extending within said evaporator and said condenser, a liquid conducting means abuttingly contacting said beveled surfaces within said evaporator section for conducting liquid from said channel to said evaporator wick means, and a liquid transporting means abuttingly contacting said beveled surfaces within said condenser section for transporting liquid from said condenser wick means to said channel.

2. The heat pipe of claim 1, further comprising means for priming said heat pipe.

3. The heat pipe of claim 2, wherein said channel extends between said evaporator section and said condenser section whereby said artery may be vented when said heat pipe is being primed.

4. The heat pipe of claim 3, further comprising a porous screen covering said channel extending between said evaporator section and said condenser section.

5. The heat pipe of claim 3, wherein said liquid conducting means and said liquid transporting means each comprise a porous capillary slab.

6. The heat pipe of claim 5, wherein said beveled surfaces are oriented parallel to the centerline of said artery; each of said capillary slabs abuttingly contacting said beveled surfaces.

7. The heat pipe of claim 6, wherein said evaporator wick means and said condenser wick means each comprise a plurality of grooves capable of conducting liquid by capillary action.

8. The heat pipe of claim 7, wherein said envelope is a tube, said grooves extend circumferentially within the interior periphery of said tube; and said slabs extending radially outwardly from said channel to said grooves.

* * * * *